US005383668A

United States Patent [19]

Andrikian

[11] Patent Number: 5,383,668

[45] Date of Patent: Jan. 24, 1995

[54] GOLF TEE

[76] Inventor: Ronald V. Andrikian, 5113 Edsel Ave., Los Angeles, Calif. 90066

[21] Appl. No.: 95,730

[22] Filed: Jul. 22, 1993

[51] Int. Cl.[6] ..... A63B 57/00

[52] U.S. Cl. ..... 273/201; 273/33; 273/195 R

[58] Field of Search ..... 273/195 R, 196, 197 R, 273/198, 195 A, 195 B, 197 A, 33, 201, 202, 203, 204, 205, 206, 207, 208, 209, 210, 211, 212

[56] References Cited

U.S. PATENT DOCUMENTS

| | | | |
|---|---|---|---|
| 1,671,813 | 4/1928 | Clarke . | |
| 1,783,211 | 12/1930 | Baldwin . | |
| 1,810,906 | 6/1931 | Carter | 273/206 |
| 1,850,560 | 3/1932 | Middendorf | 273/33 |
| 2,119,044 | 5/1938 | Davids . | |
| 2,432,209 | 12/1947 | Osgood . | |
| 4,106,772 | 8/1978 | Krawagna . | |
| 4,162,071 | 7/1979 | Fish et al. | 273/33 |
| 4,260,157 | 4/1981 | Jones et al. . | |
| 5,259,622 | 11/1993 | Irving | 273/201 |

FOREIGN PATENT DOCUMENTS

| | | | |
|---|---|---|---|
| 305820 | 2/1929 | United Kingdom | 273/33 |

OTHER PUBLICATIONS

The 1991 products manifest for Hamilton Golf Company, "It's all a lie, the best possible lie yet!".

Mid Summer 1993 Hammacher Schlemmer catalogue, "Personal Golf Ball Dispenser".

Photographs of a Golf Tee by First Pioneer Company, operable with a golf ball dispenser. Summer 1993.

*Primary Examiner*—Mark S. Graham

*Attorney, Agent, or Firm*—Merchant, Gould, Smith, Edell, Welter & Schmidt

[57] ABSTRACT

A golf practice tee includes a base, a shaft extending from the base, a cup on top of the shaft and a ramp to facilitate rolling the ball onto the cup. The ramp slope has a sloping surface which may be concave, convex, flat or may include tracks. The tee is made of a flexible material, and the base includes a flat section which is located under a practice mat. The bottom of the ramp fits adjacent the top of the mat. The top of the base may include spikes to facilitate gripping the underneath of the mat. The space between the top of the base and the bottom of the ramp can be varied by having removable inserts located on top of the base.

31 Claims, 2 Drawing Sheets

GOLF TEE

BACKGROUND

Having a useful golf tee to facilitate mounting a golf ball on the cup of the tee is highly desirable.

This invention relates to a golf tee. In particular it relates to a practice golf tee for use with a practice mat at golf driving ranges.

It is known to have a practice golf tee which includes a flat base and an upstanding shaft which protrudes through an aperture in the mat. Such a golf tee provides a cup for mounting the ball which is essentially little different to a cup used in a conventional golf tee used on a golf course.

A golfer needs to bend and place a ball on the practice tee every time the tee has to be used. This can be undesirable, especially since practicing golf can involve hitting many hundreds of balls repetitively in a short time frame.

SUMMARY

The present invention seeks to minimize the disadvantages of know golfing tees.

According to the invention a golf tee comprises a base, a shaft having a bottom and a top, the shaft being rigidly anchored to the base. There is a cup located at the top of the shaft for receiving a ball. An upwardly sloping ramp leads to the cup from a location adjacent to the shaft. The ramp has a free end and the free end is spaced above the base such that there is a space between the ramp and the base.

The base fits underneath a practice mat and includes a surface to engage the underneath of the practice mat. The shaft protrudes through a hole in the practice mat. The free end of the ramp is located substantially adjacent to the top of the practice mat surface.

In this manner a ball can be rolled up the ramp by using the head of a golf club to urge the ball up the ramp. When the ball is substantially at the top of the ramp it is located in the cup.

The invention is further described with reference to the accompanying drawings.

DRAWINGS

DESCRIPTION

Figure 1:
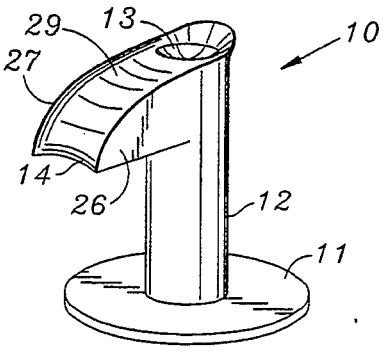
FIG. 1 is a perspective view of an embodiment of a golf tee.
Figure 2:
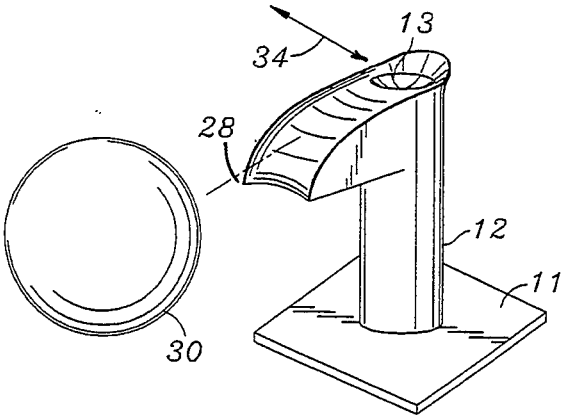
FIG. 2 is a perspective view of a second embodiment of the golf tee with a golf ball.
Figure 3:
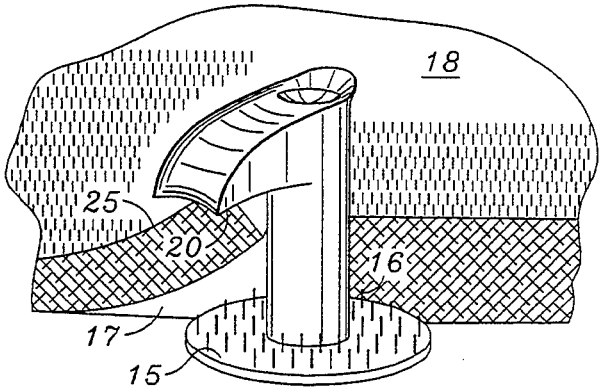
FIG. 3 is a perspective view of a third embodiment of the golf tee with a golf mat.
Figure 4:
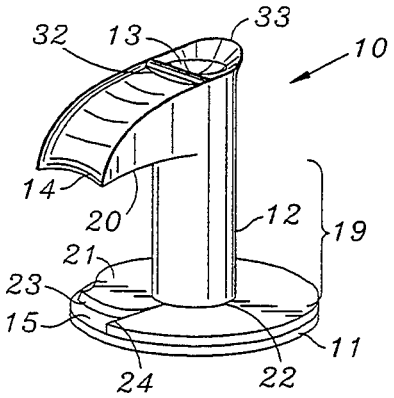
FIG. 4 is a perspective view of a fourth embodiment of the golf tee with a removable insert.
Figure 5:
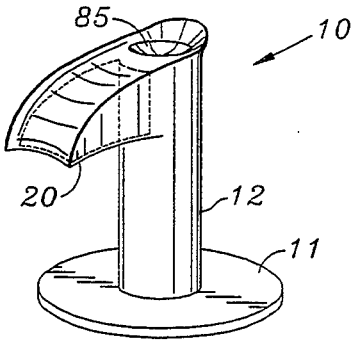
FIG. 5 is a fifth embodiment of the golf tee.
Figure 6:
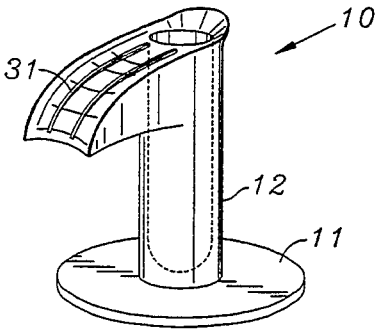
FIG. 6 is a sixth embodiment of the golf tee.
Figure 7:
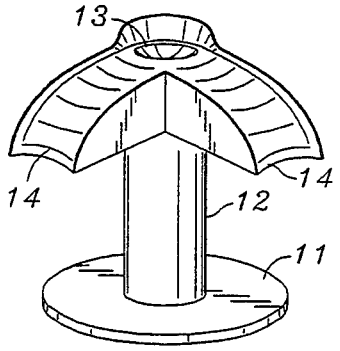
FIG. 7 is a seventh embodiment of the golf tee.
Figure 8:
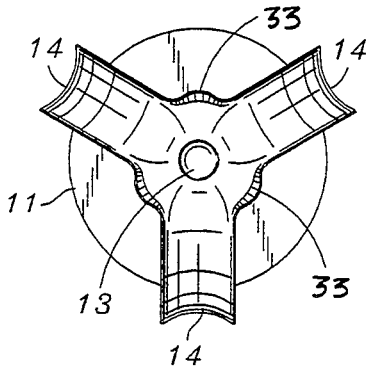
FIG. 8 is an eighth embodiment of the golf tee.
Figure 9:
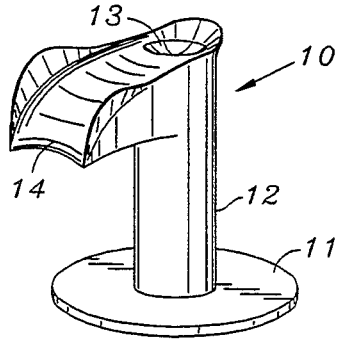
FIG. 9 is a ninth embodiment of the golf tee.
Figure 10:
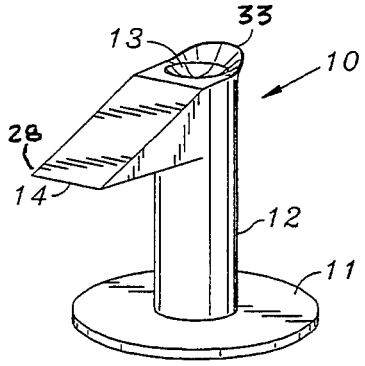
FIG. 10 is a tenth embodiment of the golf tee.
Figure 11:
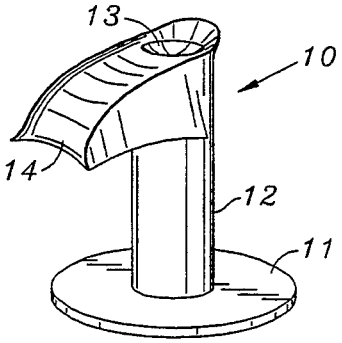
FIG. 11 is an eleventh embodiment of the golf tee.
Figure 12:
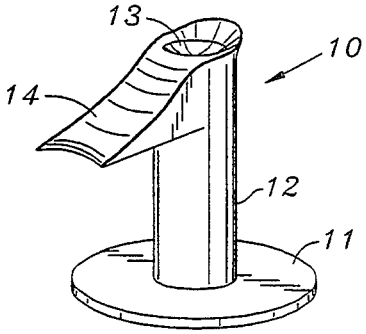
FIG. 12 is an twelfth embodiment of the golf tee.
Figure 13:
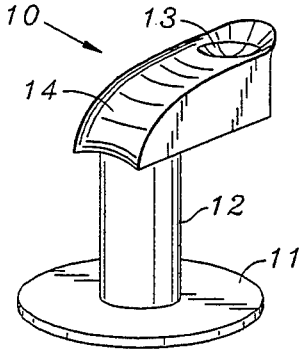
FIG. 13 is a thirteenth embodiment of the golf tee.

A golf tee 10 includes a base 11, a shaft 12, a cup 13 and a ramp 14.

The base 11 is selectively circular and surrounds the shaft 12. Alternatively, the base 11 can be square and located to surround the shaft 12. Any other shape of base is also possible. In one embodiment, the top surface 15 of the base includes spikes 16 for receiving the underside 17 of a practice mat 18.

The shaft 12 is spaced a length 19 between the top 15 of the base and the underside 20 of the ramp 14. Different mat thicknesses can be accommodated by providing a removable insert 21. This is of a flexible material and has an aperture 22 to permit easy location on or removal from the top of the base 11. The sides 23 and 24 of the insert 21 can be separated and the insert 21 can be located about the shaft 12 as required. This reduces the effective length of space 19 so that the golf tee can fit appropriately with the mat 18 between the bottom 20 of the ramp 14 and the top of the base 11.

The ramp 14 rests with the underneath 20 on the top surface 25 on the mat 18. The ramp 14 has opposite sides 26 and 27 and a free end 28. Between the free end 28 and the cup 13 there is a slope which can be selectively convex, linear or concave as required. The sides 26 and 27 can be parallel with each other. Alternatively the sides 26 and 27 can be tapered inwardly towards the shaft 12 or alternatively tapered outwardly towards the shaft 12.

The surface 29 of the ramp 14 can be concave to conform to the curvature of a golf ball 30. Alternatively surface 29 can be the flat face or be convex. Alternatively or additionally longitudinally directed tracks 31 can be provided between the free end 28 and the cup 13. The ramp 14 can also be shaped to have the same width at the top as the bottom. Alternatively, the ramp 14 can be relatively wider or narrower at the top or bottom as required.

The golf tee 10 includes a peak 32, namely the highest point. This can be at the top of the shaft 12, namely the rim of the cup 13 or alternatively and additionally the peak 33 of the ramp 14. The peak 32 and peak 33 would define the cup 13 for receiving the golf ball 30 in the resting position.

The actual shape of the cup 13 may vary as necessary, namely it may be uniform about the shaft 12 or the cup 13 can be formed with oppositely located peaks 32 and 33. Peaks 32 and 33 are not necessary to extend circumferentially around the cup 13. The cup 13 can be formed as a dimple on top of the shaft 12.

In use the ramp 14 would be directed at right angles to the line of the player and a golf club would follow a line of movement as indicated by arrow 34.

The ramp 14 may be solid or partly hollow adjacent to the bottom 20 of the ramp 14. The shaft 12 may be solid or partly hollow. If solid there may be a dimple 85 provided at the top of the shaft end to facilitate cupping the ball, constituting at least part of the cup 13.

The tee 10 is made of a material which is flexible and resilient. A rubber or plastic can be used. The golf tee 10 needs to be capable of withstanding multiple re-use and/or repetitive use.

Many variations of the invention are possible. For instance, there can be multiple ramps about the shaft, the multiple ramps being spaced circumferentially about the shaft. Also there can be multiple stoppers located opposite each respective multiple ramp circumferentially about the shaft 12. In a situation with a single ramp 14, the peak 33 would act as an appropriate stopper.

In other cases, although the ramp 14 is illustrated to be centrally located about the shaft there can be situations where the ramp 14 is offset. The ramp free end 28 would be adjacent to the shaft, and be directed radially from the shaft 12 such that the cup 13 is located offset from the line of the shaft 12 and not centrally on top of the shaft 12. In this form, the free end 28 is formed to develop from the top of the shaft 12.

Many other forms of the invention exist each differing from the other in matters of detail only. For instance, the ramp surface may be textured to facilitate gripping the ball. Lateral tracks can be used. Different rubbers can be used for the tee. Thus, a softer rubber may improve the grip on the ball. The height of the ramp can be different to facilitate golfer preference.

In other cases, instead of spikes 16, there may be radial or circumferential ribs. The length of shaft 19 can be varied to match different thicknesses of mats.

In yet other forms, the sides 26 and 27 of the ramp 14 may be of different relative cross-sections to each other. Either or both may have different cutouts or reinforcements. The ramp 14 and peak 33 may be provided as a separate add-on piece to fit with shaft 19.

In some cases, the base may be provided separately below the mat and the shaft is connected with the base, for instance, by screw means or insertion into an aperture in the base.

The invention is to be determined solely in terms of the following claims.

I claim:

1. A golf tee comprising:

(a) a base, (b) a shaft having a bottom and a top, the shaft being rigidly anchored to the base, (c) a cup on top of the shaft for receiving a golf ball, and (d) an upwardly directed ramp for a golf ball, the ramp leading to the cup from a location adjacent to the shaft, the ramp having a free end, the free end being spaced above the base such that there is a space between the ramp and the base;

wherein the ramp includes a sloping surface extending between a free end of the ramp and a position of the ramp adjacent to and adjoined the cup, the sloping surface having a shape which is convex along at least part of the length between the free end and the end adjacent to the cup.

2. The tee as claimed in claim 1 wherein the surface is for rolling a ball upwardly, the surface including tracks directed longitudinally between opposite sides of the ramp for at least part of the length between the free end and the position adjacent to the cup.

3. The tee as claimed in claim 2 wherein the ramp includes opposite sides, the opposite sides being substantially parallel with each other.

4. A tee as claimed in claim 1 including a peak, the peak being formed by the top of the ramp, the top of the ramp being between the free end portion and the cup.

5. A tee as claimed in claim 1 wherein the base includes a relatively flat face, the flat face forming a foundation for location below a practice mat having an aperture for receiving a protruding shaft, and wherein the flat face includes means for gripping the mat.

6. A tee as claimed in claim 1 wherein the shaft defines a length, the length being defined by a space between a bottom of the ramp and a top of the base, and including a removable insert locatable on a top surface of the base thereby to lessen the effective space between the top of the base and the bottom of the ramp.

7. A tee as claimed in claim 1 wherein the shaft is hollow.

8. A tee as claimed in claim 1 including a stopper, the stopper being located in a position about the shaft opposite the ramp.

9. A tee as claimed in claim 1 including multiple ramps arranged circumferentially about the shaft.

10. A tee as claimed in claim 9 including multiple stoppers arranged circumferentially about the shaft, the stoppers being arranged opposite respective ramps.

11. A tee as claimed in claim 1 wherein the tee is made of a material which is flexible and resilient.

12. A golf tee as claimed in claim 1 including a stopper, and wherein the ramp is aligned with the cup and the stopper, the stopper being located opposite the ramp with the cup between the ramp and stopper, and wherein the alignment of ramp, stopper and cup is substantially transverse to a line of flight of a head of a golf club whereby the ball when struck by a golf head would leave the cup in a direction transverse to the alignment.

13. A golf tee as claimed in claim 1 wherein the ramp and cup define an alignment, and wherein the alignment is transverse to the intended direction of departure of a ball from the cup when struck by a golf club head.

14. The tee as claimed in claim 1 wherein the ramp includes opposite sides tapering relative to each other from a free end position located away from the shaft to a position towards the shaft.

15. The tee as claimed in claim 1 wherein the surface is for rolling the ball upwardly, the surface being concave between opposite sides of the ramp.

16. A tee as claimed in claim 1 wherein the shaft is solid and includes a dimple on the top of the shaft to form the cup.

17. A golf tee comprising:

(a) a base, (b) a shaft having a bottom and a top, the shaft being rigidly anchored to the base, (c) a cup on top of the shaft for receiving a golf ball, and (d) an upwardly directed ramp leading to the cup from a location adjacent to the shaft for directing a ball from the ramp to the cup, the ramp having a free end, the free end being spaced above the base such that there is a space between the ramp and the base, the ramp including a sloping surface extending between a free end of the ramp and a position of the ramp adjacent to the cup, the ramp being formed to depend from the shaft, the sloping surface being along at least part of the length between the free end and the end adjacent to the cup, the base including a relatively flat face, the flat face forming a foundation for location below a practice mat having an aperture for receiving a protruding shaft, and the flat face having means for gripping the mat.

18. A tee as claimed in claim 17 wherein the shaft defines a space length, the length being defined by a space between a bottom of the ramp and a top of the base, and a including a removable insert locatable on a top surface of the base thereby to lessen the effective space between the top of the base and the bottom of the ramp.

19. A tee as claimed in claim 18 wherein the tee is made of a material which is flexible and resilient and the sloping surface is convex between at least part of the free end and the end adjacent to the cup, and the ramp including opposite sides and being at least partly concave between the opposite sides.

20. A golf tee as claimed in claim 17 wherein the ramp and cup define an alignment, and wherein the alignment is transverse to the intended direction of departure of a ball from the cup when struck by a golf club head.

21. A golf tee as claimed in claim 17 wherein the ramp includes opposite sides extending between the free end and the cup, and wherein a surface is defined between the opposite sides, the surface being at least partly concave between the opposite sides.

22. (Amended) A golf tee comprising:

(a) a base, (b) a shaft having a bottom and a top, the shaft being rigidly anchored to the base, (c) a cup on top of the shaft for receiving a golf ball, and (d) an upwardly directed ramp leading to the cup from a location adjacent to the shaft for directing a ball up the ramp into the cup, the ramp having a free end, the free end being spaced above the base such that there is a space between the ramp and the base, the ramp including opposite sides, the opposite sides being substantially parallel with each other, and the ramp including a surface between the free end and the location adjacent to the cup, the surface being for rolling a ball upwardly, the surface being convex between the free end and the position adjacent to the cup, and the surface extending between opposite sides of the ramp, the surface being at least partly concave between the opposite sides of the ramp.

23. A tee as claimed in claim 22 wherein the base includes a relatively flat face, the flat face forming a foundation for location below a practice mat, having an aperture for receiving a protruding shaft, and wherein the flat face is locatable underneath of the mat.

24. A tee as claimed in claim 23 wherein the tee is made of a material which is flexible and resilient.

25. A golf tee as claimed in claim 22 wherein the ramp and cup define an alignment, and wherein the alignment is transverse to the intended direction of departure of a ball from the cup when struck by a golf club head.

26. A golf tee as claimed in claim 22 wherein the ramp includes opposite sides extending between the free end and the cup, and wherein a surface is defined between the opposite sides, the surface being at least partly concave between the opposite sides.

27. A golf tee comprising:

(a) a shaft having a bottom and a top, the shaft being rigidly anchored to a base, (b) a cup on top of the shaft for receiving a golf ball, and (c) an upwardly directed ramp leading to the cup from a location adjacent to the shaft, the ramp being for directing a ball to the cup, and the ramp having a free end, the free end being spaced above the base such that there is a space between the ramp and the base, and the ramp having opposite sides with a surface defined between the opposite sides, and the surface being at least partly concave between the opposite sides.

28. A golf tee as claimed in claim 27 wherein the ramp and cup define an alignment, and wherein the alignment is transverse to the intended direction of departure of a ball from the cup when struck by a golf club head.

29. A golf tee as claimed in claim 27 wherein the ramp includes opposite sides extending between the free end and the cup, and wherein a surface is defined between the opposite sides, the surface being at least partly concave between the opposite sides.

30. A golf tee comprising:

(a) a base, (b) a shaft having a bottom and a top, the shaft being rigidly anchored to the base, (c) a cup on top of the shaft for receiving a golf ball, and (d) an upwardly directed ramp for a golf ball, the ramp leading to the cup from a location adjacent to the shaft, the ramp having a free end, the free end being spaced above the base such that there is a space between the ramp and the base;

wherein the ramp includes a sloping surface extending between a free end of the ramp and a position of the ramp adjacent to and adjoined the cup, the sloping surface having a shape which is convex or linear along at least part of the length between the free end and the end adjacent to the cup.

31. A golf tee comprising:

(a) a base, (b) a shaft having a bottom and a top, the shaft being rigidly anchored to the base, (c) a cup on top of the shaft for receiving a golf ball, and (d) an upwardly directed ramp for a golf ball, the ramp leading to the cup from a location adjacent to the shaft, the ramp having a free end, the free end being spaced above the base such that there is a space between the ramp and the base;

wherein the ramp includes a sloping surface extending between a free end of the ramp and a position of the ramp adjacent to and adjoined the cup, the sloping surface having a shape which is convex or concave along at least part of the length between the free end and the end adjacent to the cup.

* * * * *